US005903657A

United States Patent [19]

Chuo

[11] Patent Number: 5,903,657

[45] Date of Patent: May 11, 1999

[54] METHOD FOR EXTERNALLY HANGING SPEAKERS ON COMPUTER MONITOR AND A DEVICE THEREOF

[75] Inventor: Yu-Hsin Chuo, Taipei, Taiwan

[73] Assignee: Compal Electronics, Inc., Taipei, Taiwan

[21] Appl. No.: 09/046,592

[22] Filed: Mar. 24, 1998

[51] Int. Cl.[6] ..... H04R 25/00

[52] U.S. Cl. ..... 381/388; 381/395; 381/333; 361/683

[58] Field of Search ..... 381/332, 333, 381/386, 388, 395; 361/683, 680, 682, 681; 181/141

[56] References Cited

U.S. PATENT DOCUMENTS 5,400,408 3/1995 Lungdren et al. ..... 381/333

*Primary Examiner*—Huyen Le
*Attorney, Agent, or Firm*—Bacon & Thomas, PLLC

[57] ABSTRACT

A method for externally hanging speakers on computer monitor and a device thereof, in which the computer monitor is composed of a front and a rear casings mated with each other by screws. A hidden insertion hole is formed in each original passage of the rear casing for hooking the hanging hook of the speakers. After the speaker is removed, no track of damage of the appearance of the computer monitor will be seen. Therefore, the speakers can be hung on the computer monitor without breaking the appearance of the computer monitor.

5 Claims, 7 Drawing Sheets

METHOD FOR EXTERNALLY HANGING SPEAKERS ON COMPUTER MONITOR AND A DEVICE THEREOF

BACKGROUND OF THE INVENTION

The present invention relates to a method for externally hanging speakers on computer monitor and a device thereof, in which the computer monitor is composed of a front and a rear casings mated with each other by screws. A hidden insertion hole is formed in each original passage of the rear casing for hooking the hanging hook of the speakers.

An externally connected speaker has become an inevitable peripheral equipment of a computer. In order achieve a beautiful appearance, the manufacturers have tried to assemble the externally connected speaker with the computer monitor as an integral unit.

FIG. 1 shows a conventional measure for externally hanging the speaker on the computer monitor. The rear casing 10 of the computer monitor is formed with thread holes 14 for hanging the speaker 12. The speaker 12 is formed with a thread hole 16 corresponding to the thread holes 14 of the monitor, whereby a bolt 18 is passed through the thread hole 16 of the speaker 12 and tightened in one of the thread holes 14 of the monitor. Accordingly, once the speaker is removed, the deep and not hidden thread hole 14 will be left on the rear casing 10 of the monitor.

FIG. 2 shows another conventional measure for externally hanging the speaker on the computer monitor, in which the adjoining section of the front and rear casings 20, 22 of the monitor is formed with an upper and a lower openings 24, 26 for hanging the hanging hooks 30, 32 of the speaker 28. According to such arrangement, after the speaker is removed, two openings 24, 26 will be left on the lateral adjoining section of the front and rear casings 20, 22 of the monitor.

FIG. 3 shows still another conventional measure for externally hanging the speaker on the monitor, which is different from the measure of FIG. 2 in that the openings 36 are formed on back side of the rear casing 38 for hanging the hanging hook 34 of the speaker. Similarly, after the speaker is removed, the openings 36 will be clearly left.

SUMMARY OF THE INVENTION

It is a primary object of the present invention to provide a method for externally hanging speakers on computer monitor and a device thereof, which enables two speakers to be hung on two sides of the computer monitor without breaking the appearance of the computer monitor.

According to the above object, the hanging method of the present invention includes the steps of:

a) providing a computer monitor composed of a front and a rear casings mated with each other by screws on two sides, the rear casing being formed with passages for the screws to pass therethrough; and b) providing two speakers having a profile as two sides of the computer monitor.

The hanging method of the present invention is characterized by the steps of:

c) forming an insertion hole in each passage;

d) forming a hanging hook on a surface of each speaker corresponding to and extending toward the passage; and e) forward inserting the hanging hook of the speaker from the back of the rear casing into the insertion hole of the passage.

The hanging device of the present invention includes a computer monitor and two speakers having a profile as two sides of the computer monitor. The monitor has a front and a rear casings. The back of the front casing is formed with at least one thread holes and the back of the rear casing is correspondingly formed with at least one passages. A screw is passed through each passage and screwed into the corresponding thread hole of the front casing. The hanging device is characterized in that an insertion hole is formed in each passage and a surface of each speaker is disposed with a hanging hook corresponding to and extending toward the passage, whereby the hanging hook can be forward inserted from the back of the rear casing into the insertion hole of the passage so as to hang two speakers respectively on two sides of the monitor. After the speakers are removed, the insertion hole is hidden in each passage and it is uneasy to see the insertion hole for hanging the speaker.

The present invention can be best understood through the following description and accompanying drawings, wherein:

DETAILED DESCRIPTION OF THE PREFERRED EMBODIMENT

Figure 1:
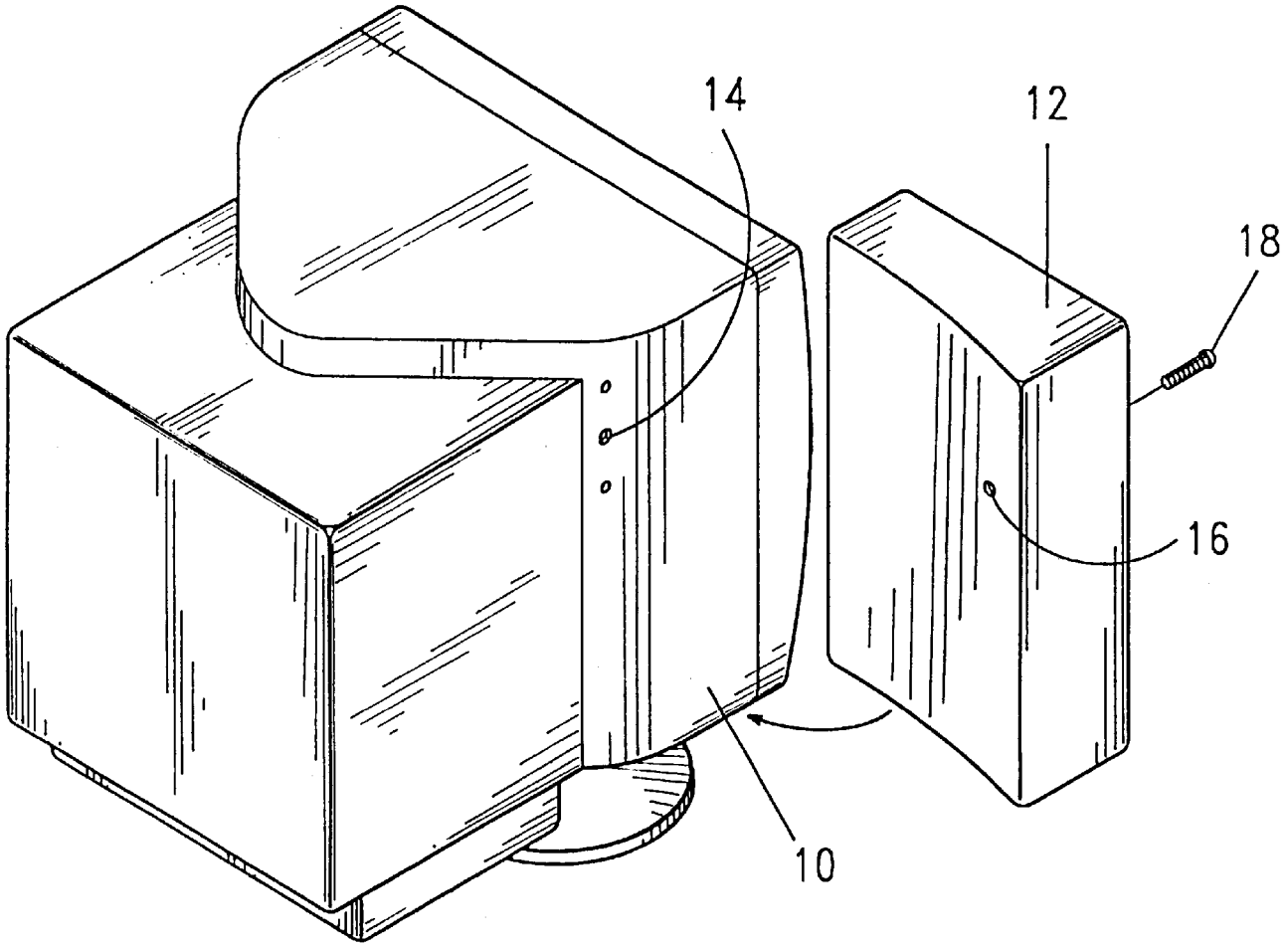
Fig. 1 ( PRIOR ART )
FIG. 1 is a perspective exploded view of a first conventional measure for externally hanging speakers on computer monitor.
Figure 2:
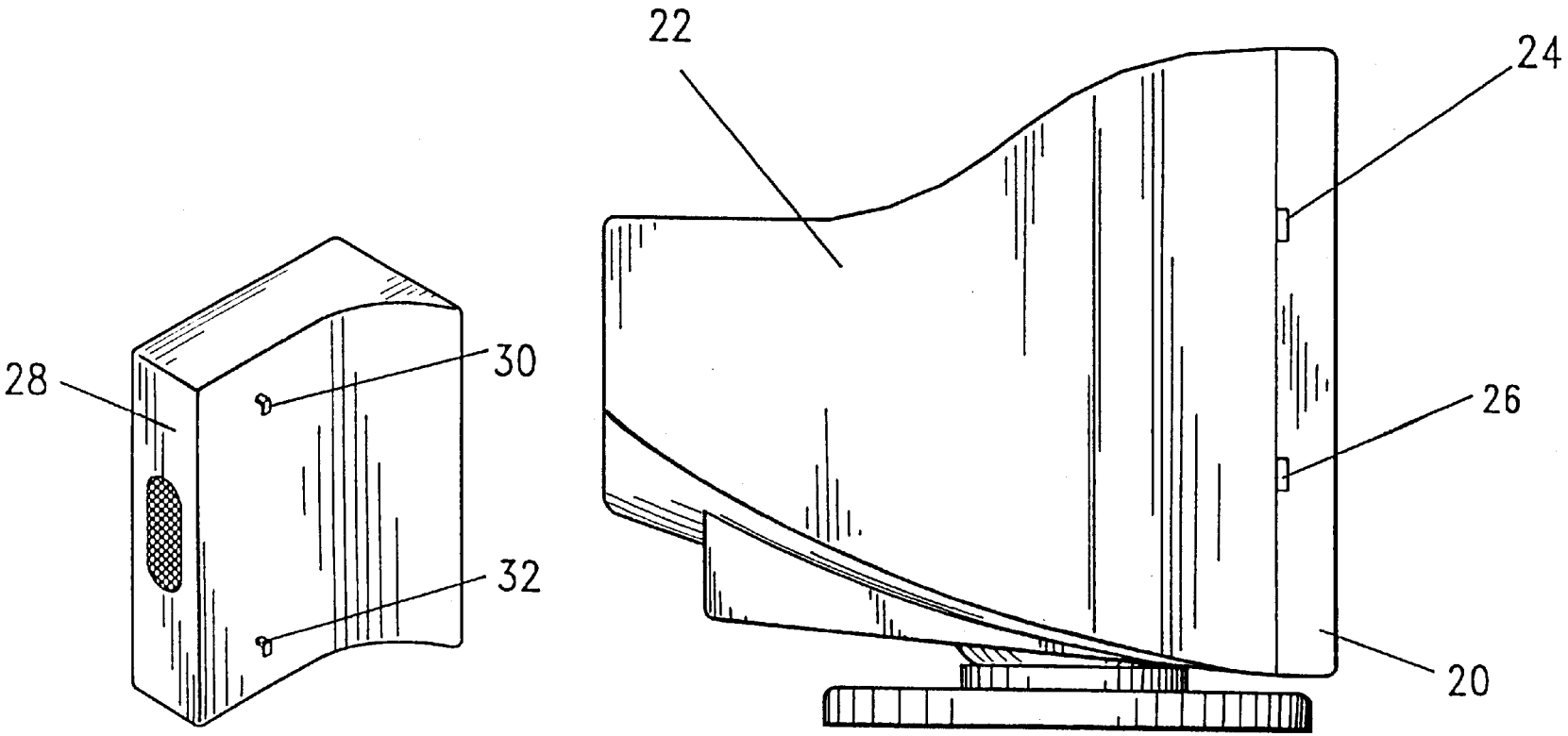
Fig. 2 ( PRIOR ART )
FIG. 2 is a perspective exploded view of a second conventional measure for externally hanging speakers on computer monitor.
Figure 3:
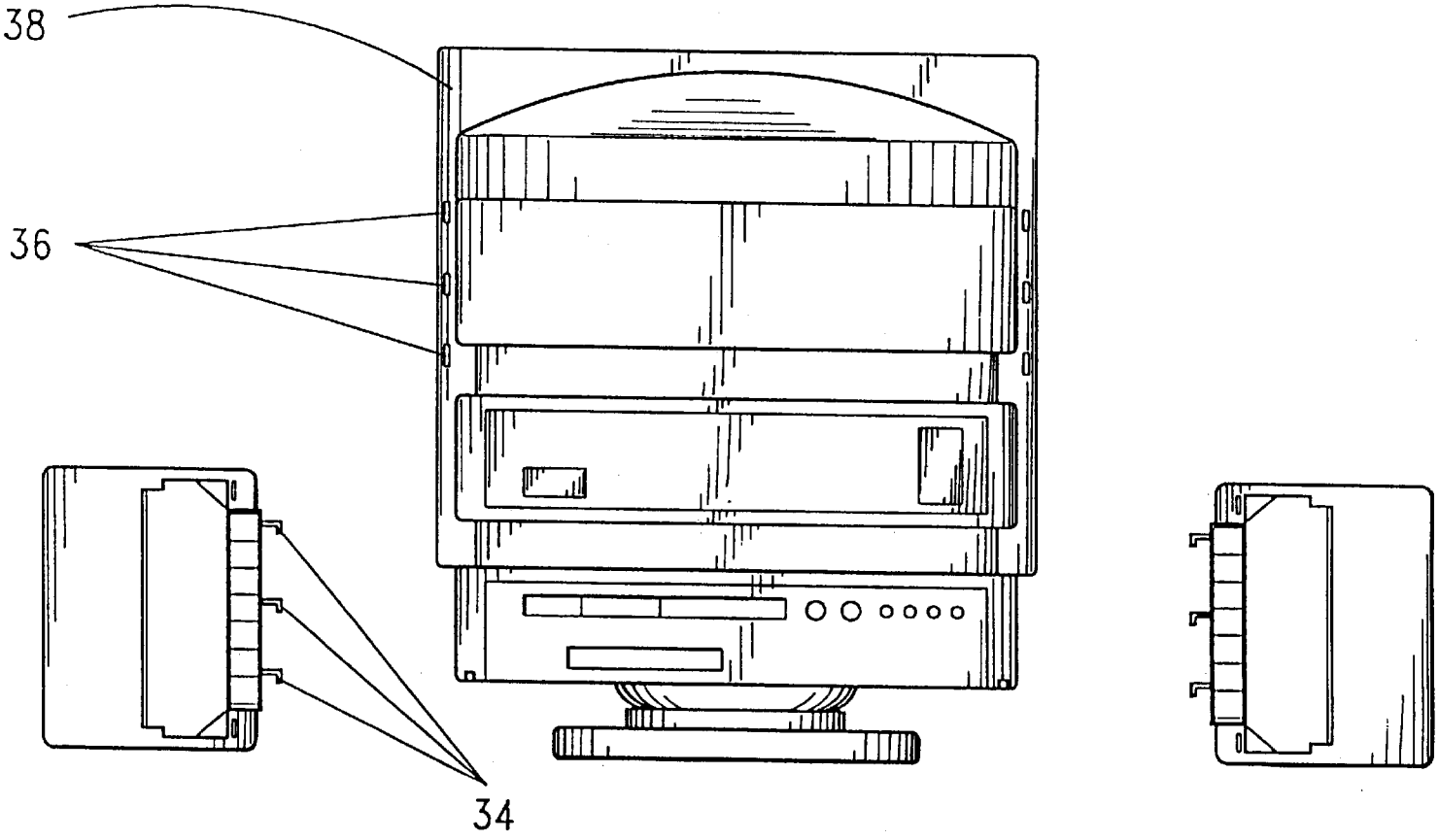
Fig. 3 (PRIOR ART)
FIG. 3 is a perspective exploded view of a third conventional measure for externally hanging speakers on computer monitor.
Figure 4A:
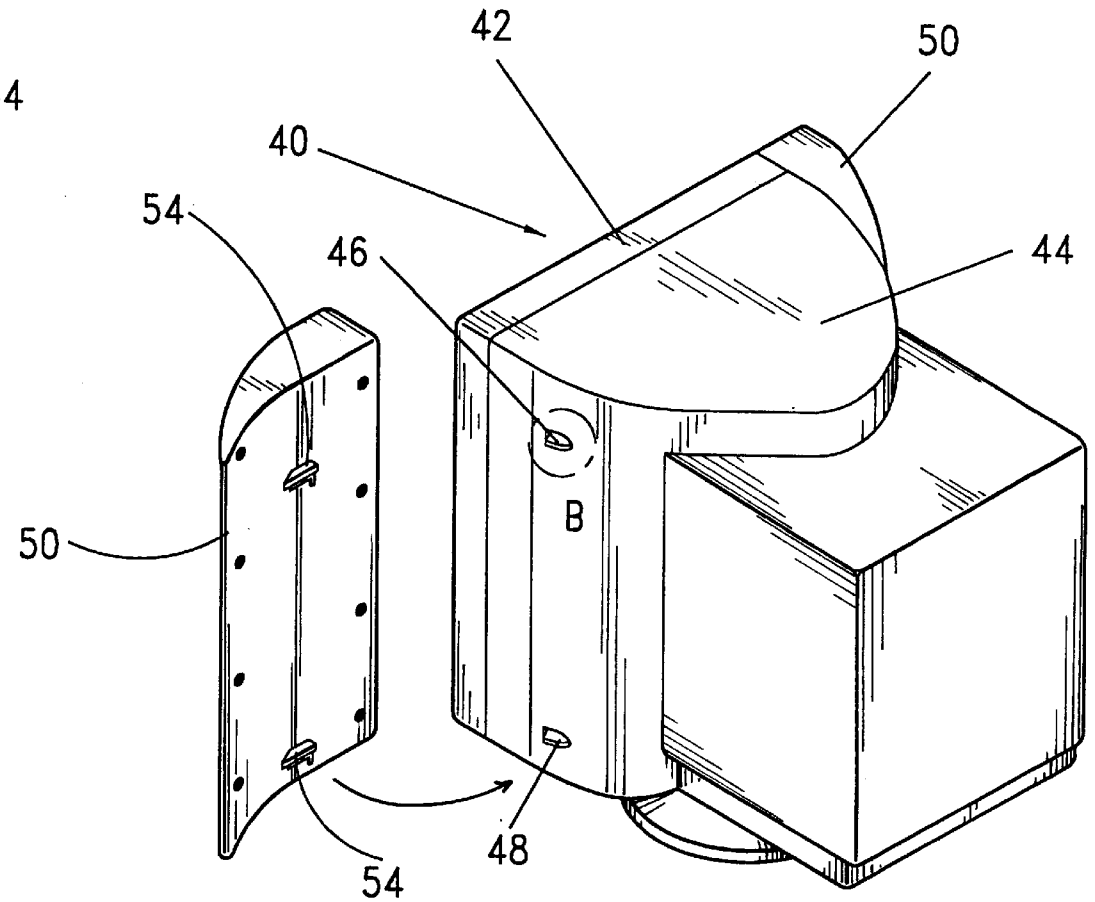
FIG. 4A is a perspective exploded view of the hanging device of the present invention.
Figure 4B:
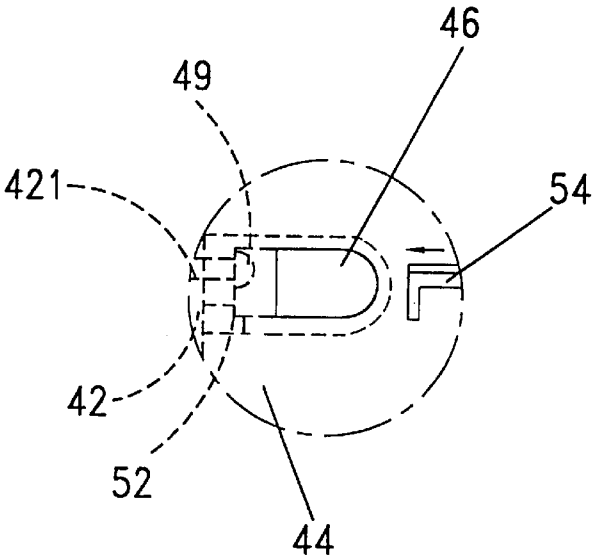
FIG. 4B shows the structure of area B of FIG. 4A before assembled with hanging hook of the speaker.
Figure 5:
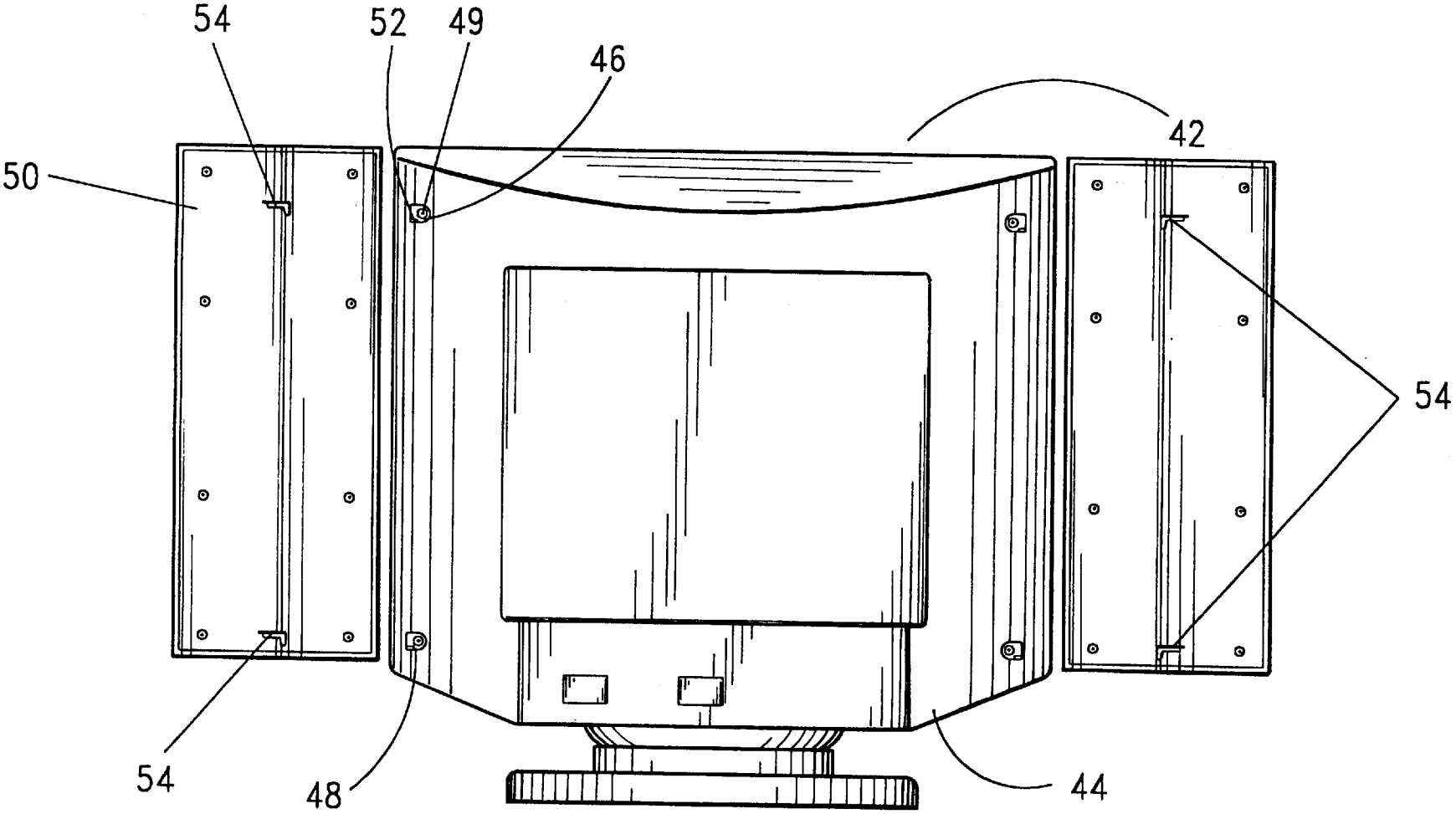
FIG. 5 is a rear view according to FIG. 4.

Please refer to FIGS. 4A and 4B. The hanging device of the present invention includes a computer monitor 40 and two speakers 50 having a profile as two sides of the computer monitor. (The number of the speakers is changeable according to the model and pattern of the monitor.) The monitor 40 has a front and a rear casings 42, 44. Two sides of the back of the front casing are oppositely formed with upper and lower thread holes 421. Two sides of the back of the rear casing 44 are correspondingly formed with upper and lower passages 46, 48. A screw 49 ( as shown in FIG. 5 ) is passed through each passage 46, 48 and screwed into the corresponding thread hole 421 of the front casing 42. The above passages 46, 48 of the rear casing 44 pertain to prior art for assembling the rear casing 44 with the front casing 42.

Figure 6:
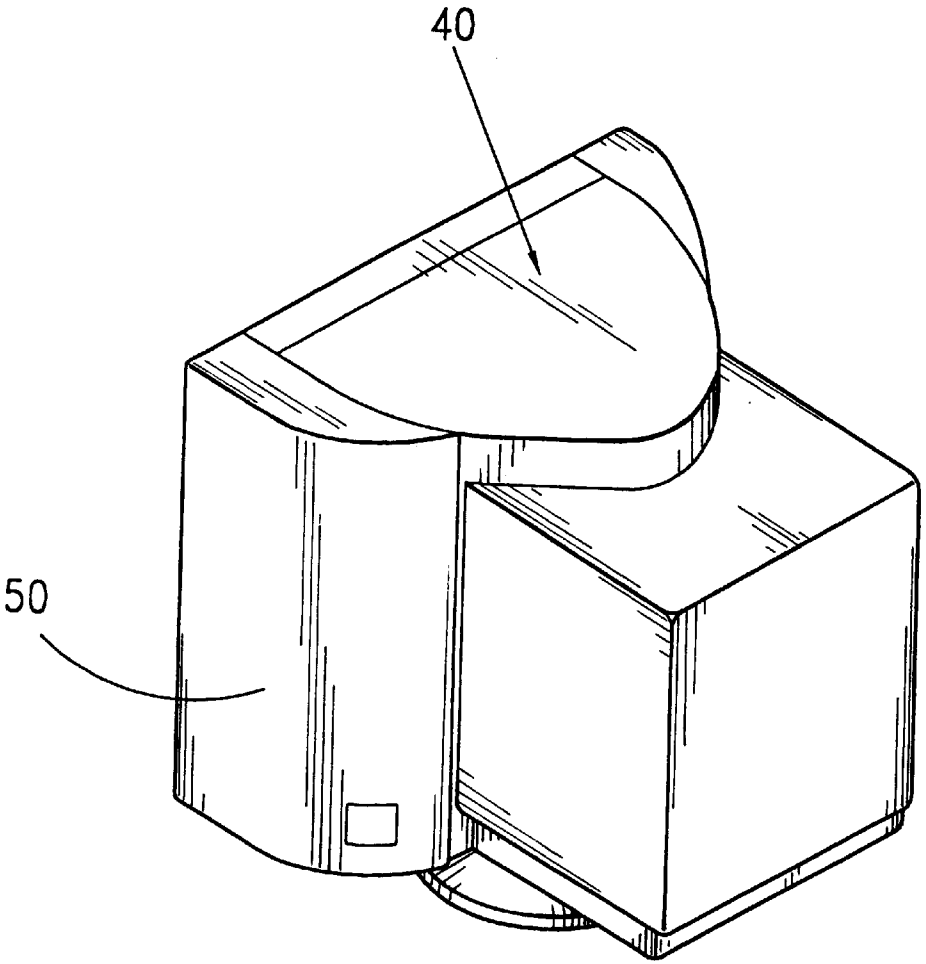
FIG. 6 is a perspective assembled view according to FIG. 5.
Figure 7:
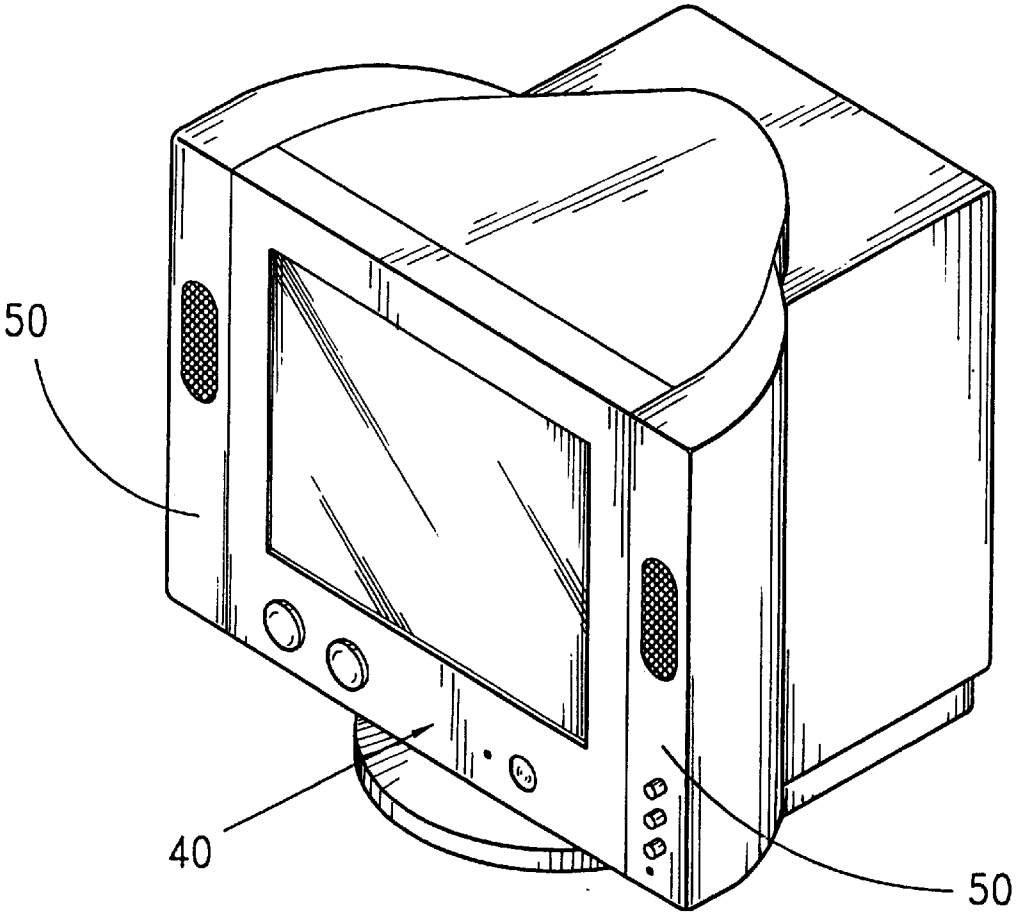
FIG. 7 is front perspective view according to FIG. 6.

Please refer to FIG. 5 which is a rear view of the present invention. An insertion hole 52 is formed in each passage 46, 48. The surface of each speaker 50 is disposed with a hanging hook 54 corresponding to and extending toward the passage 46, 48. When hanging the speaker 50, the hanging hook 54 can be forward inserted from the back of the rear casing 44 into the insertion hole 52 of the passage 46, 48 so as to hang two speakers 50 respectively on two sides of the monitor 40 as shown in FIGS. 6 and 7.

After the speaker 50 is removed, the insertion hole 52 for hanging the speaker 50 is deeply hidden in each passage 46, 48. Unless seen by the angle of FIG. 4, it will be quite uneasy to see any means for hanging the speaker 50 on the monitor 40 by other angles.

It should be noted that the above upper and lower passages 46, 48 of the rear casing 44 are included in a preferred embodiment of the present invention. In a modified embodiment of the present invention, the lower passage 48 can be substituted by other measure. Under such circumstance, the lower hanging hook 54 of the speaker 50 can be removed.

According to the above hanging device, the hanging method of the present invention includes the steps of:

a) providing a computer monitor composed of a front and a rear casings mated with each other by screws on two sides, the rear casing being formed with passages for the screws to pass therethrough;

b) providing two speakers having a profile as two sides of the computer monitor;

c) forming an insertion hole in each passage;

d) forming a hanging hook on a surface of each speaker corresponding to and extending toward the passage; and e) forward inserting the hanging hook of the speaker from the back of the rear casing into the insertion hole of the passage.

According to the above arrangement, the hanging hook of the speaker can be easily inserted into the insertion hole in the passage of the rear casing so as to hang the speaker on the monitor. In addition, after the speaker is removed, no track of damage of the appearance of the monitor will be seen. Therefore, the speakers can be hung on the computer monitor without breaking the appearance of the computer monitor.

It should be noted that the above description and accompanying drawings are only used to illustrate one embodiment of the present invention, not intended to limit the scope thereof. Any modification of the embodiment should fall within the scope of the present invention.

What is claimed is:

1. A method for externally hanging speakers on a computer monitor, comprising the steps of:

providing a computer monitor composed of front and rear casings mated with each other by screws on two sides, the rear casing being formed with passages each having an opening on the exterior surface of the monitor for the screw to pass therethrough; and providing two speakers having a profile as two sides of the computer monitor, said method being characterized by the steps of:

forming an insertion hole in each passage, said insertion hole being arranged so that a hanging hook can be engaged from outside the monitor casing;

forming one or more hanging hooks on a surface of each speaker corresponding to and extending toward a respective passage, each said hanging hook having one end of a shank portion attached to said surface and a remote end of said shank portion having a barb extending at an angle from said shank; and inserting said each hanging hook of the speaker from a respective side of a back of the rear casing along a respective passage thereof into the insertion hole of the passage, whereby said barb is engaged within said insertion hole.

2. A method for externally hanging speakers on a computer monitor, comprising the steps of providing a computer monitor composed of front and rear casings mated with each other by screws and forming a hidden insertion hole in each original passage having an opening on the exterior surface of the monitor of the rear casing for hooking a hanging hook of the speaker, said hanging hook being able to engage the insertion hole from the exterior of the monitor and having one end of a shank portion attached to said surface and a remote end of said shank portion having a barb extending at an angle from said shank.

3. A device for externally hanging speakers on a computer monitor, comprising a computer monitor and at least one speaker having a profile as two sides of the computer monitor, the monitor having front and rear casings, the back of the front casing being formed with at least one threaded hole, the back of the rear casing being correspondingly formed with at least one passage open to the exterior of the casing, a screw being passed through a respective passage and screwed into the corresponding threaded hole of the front casing, said device having an insertion hole formed in each passage, a surface of each speaker being disposed with a hanging hook corresponding to and extending toward the passage, whereby the hanging hook can be inserted from the back of the rear casing along the passage into the insertion hole of the passage so as to hang two speakers respectively on two sides of the monitor and after the speakers are removed, the insertion hole is hidden in each passage so that it is difficult to see the insertion hole for hanging the speaker.

4. A device as claimed in claim 3, wherein two sides of the back of the front casing are oppositely formed with upper and lower threaded holes and two sides of the back of the rear casing are correspondingly formed with upper and lower passages, the surface of each speaker being disposed with one or more sets of upper and lower hanging hooks corresponding to and extending toward respective passages.

5. A device for externally hanging speakers on a computer monitor, comprising a computer monitor and at least one speaker having a profile as two sides of the computer monitor, the monitor having front and rear casings, the back of the front casing being formed with at least one threaded hole, the back of the rear casing being correspondingly formed with at least one passage, a screw being passed through a respective passage and screwed into the corresponding threaded hole of the front casing, said device having an insertion hole formed in each passage, a surface of each speaker being disposed with a hanging hook corresponding to and extending toward the passage, whereby the hanging hook can be inserted from the back of the rear casing along the passage into the insertion hole of the passage so as to hang two speakers respectively on two sides of the monitor and after the speakers are removed, the insertion hole is hidden in each passage so that it is difficult to see the insertion hole for hanging the speaker;

wherein two sides of the back of the front casing are oppositely formed with upper and lower threaded holes and two sides of the back of the rear casing are correspondingly formed with upper and lower passages, the surface of each speaker being disposed with upper and lowerhanging hooks corresponding to and extending toward respective passages.

* * * * *